US008038041B2

(12) United States Patent
Skillin et al.

(10) Patent No.: US 8,038,041 B2
(45) Date of Patent: Oct. 18, 2011

(54) DISPENSING CLOSURE WITH OBSTRUCTED, OFFSET, NON-LINEAR FLOW PROFILE

(75) Inventors: Clifford Skillin, Blackstone, MA (US); Sergey Romanov, Cranston, RI (US); Patrick J. Brannon, Warwick, RI (US)

(73) Assignee: Polytop Corporation, a Rhode Island corporation, Slatersville, RI (US)

( * ) Notice: Subject to any disclaimer, the term of this patent is extended or adjusted under 35 U.S.C. 154(b) by 0 days.

(21) Appl. No.: 11/849,860

(22) Filed: Sep. 4, 2007

(65) Prior Publication Data

US 2008/0054027 A1 Mar. 6, 2008

Related U.S. Application Data

(60) Provisional application No. 60/824,322, filed on Sep. 1, 2006, provisional application No. 60/893,883, filed on Mar. 8, 2007.

(51) Int. Cl.
*B67D 3/00* (2006.01)
*B65D 39/00* (2006.01)
*B65D 51/18* (2006.01)

(52) U.S. Cl. ..... 222/547; 222/556; 222/564; 215/235; 215/306; 220/254.4; 220/291; 220/837

(58) Field of Classification Search ..... 222/547, 222/556, 571, 557, 562, 546, 564, 563, 477, 222/519, 520, 521, 454, 456, 478, 479; 215/235, 215/330, 237, 256, 254, 306; 220/254, 258.1, 220/291, 375, 259, 837, 254.4, 259.1, 259.2
See application file for complete search history.

(56) References Cited

U.S. PATENT DOCUMENTS

| | | | | |
|---|---|---|---|---|
| 330,545 | A | 11/1885 | Barker | |
| 1,844,442 | A | 2/1932 | Schmalz | |
| 2,130,749 | A | 9/1938 | Von Till | |
| 2,313,031 | A | 3/1943 | Parkhurst | |
| 2,921,724 | A * | 1/1960 | Whitney | 222/562 |
| 3,055,526 | A | 9/1962 | Plunkett | |
| 3,289,885 | A * | 12/1966 | Villaveces | 221/288 |

(Continued)

FOREIGN PATENT DOCUMENTS

DE 4214548 11/1993

(Continued)

OTHER PUBLICATIONS

Intl PCT Application No. PCT/US07/77551 Transmittal, Sep. 4, 2007.

(Continued)

*Primary Examiner* — Kevin P Shaver
*Assistant Examiner* — Stephanie E Williams
(74) *Attorney, Agent, or Firm* — Barlow, Josephs & Holmes, Ltd.

(57) ABSTRACT

A dispensing closure has a flow conduit that provides a sufficient flow restriction to prevent unwanted spurting of the product when the container is initially opened. The dispensing closure includes a closure body with an upper deck and a flow conduit extending through the upper deck. The flow conduit includes an entry orifice having an entrance axis and an exit orifice having an exit axis. The entrance axis is offset from the exit axis to provide a non-linear flow path from an interior of the closure to the exterior of the closure.

20 Claims, 5 Drawing Sheets

U.S. PATENT DOCUMENTS

| | | | | | |
|---|---|---|---|---|---|
| 3,353,725 | A | * | 11/1967 | Caceres | 222/456 |
| 3,439,843 | A | * | 4/1969 | Corsette | 222/212 |
| 3,618,170 | A | | 11/1971 | Owens | |
| 3,690,496 | A | | 9/1972 | Gibson | |
| 3,693,847 | A | * | 9/1972 | Gibson | 222/546 |
| 3,734,332 | A | | 5/1973 | Grulich | |
| 3,784,045 | A | | 1/1974 | Komendowski | |
| 3,827,593 | A | | 8/1974 | Kramb et al. | |
| 3,877,598 | A | * | 4/1975 | Hazard | 215/224 |
| 3,980,211 | A | * | 9/1976 | Owens | 222/478 |
| 4,209,485 | A | | 6/1980 | Greenspan | |
| 4,241,855 | A | * | 12/1980 | Yoshioka | 222/479 |
| 4,343,754 | A | | 8/1982 | Wilde et al. | |
| 4,487,342 | A | * | 12/1984 | Shy | 222/481.5 |
| 4,564,113 | A | | 1/1986 | Mendler | |
| 4,579,241 | A | | 4/1986 | Hayes | |
| 4,649,013 | A | | 3/1987 | Yamamoto et al. | |
| 4,749,108 | A | * | 6/1988 | Dornsbusch et al. | 222/212 |
| 4,767,587 | A | | 8/1988 | Towns et al. | |
| 4,778,071 | A | * | 10/1988 | Fillmore | 215/237 |
| 4,782,985 | A | * | 11/1988 | Kinsley | 222/481.5 |
| 4,880,140 | A | | 11/1989 | Solomon et al. | |
| 4,949,880 | A | * | 8/1990 | Bradley | 222/454 |
| 5,033,655 | A | | 7/1991 | Brown | |
| 5,048,723 | A | | 9/1991 | Seymour | |
| 5,123,575 | A | | 6/1992 | Li | |
| 5,197,634 | A | * | 3/1993 | Beck | 222/109 |
| 5,271,531 | A | | 12/1993 | Rohr et al. | |
| 5,277,318 | A | * | 1/1994 | Smalley et al. | 209/255 |
| 5,285,913 | A | | 2/1994 | Morton | |
| 5,292,020 | A | | 3/1994 | Narin | |
| 5,332,131 | A | * | 7/1994 | Pehr | 222/505 |
| 5,370,284 | A | * | 12/1994 | Dirksing | 222/534 |
| 5,472,122 | A | | 12/1995 | Appleby | |
| 5,509,582 | A | * | 4/1996 | Robbins, III | 222/158 |
| 5,512,228 | A | | 4/1996 | Adams et al. | |
| 5,518,152 | A | * | 5/1996 | Burcham et al. | 222/452 |
| 5,547,091 | A | * | 8/1996 | Neveras et al. | 215/237 |
| 5,779,110 | A | * | 7/1998 | Brown et al. | 222/556 |
| 5,819,994 | A | | 10/1998 | Leipold | |
| 5,820,807 | A | | 10/1998 | Urmston | |
| 5,875,909 | A | | 3/1999 | Guglielmini | |
| 5,992,659 | A | * | 11/1999 | Nofer et al. | 215/235 |
| 6,006,960 | A | | 12/1999 | Gross | |
| 6,029,861 | A | * | 2/2000 | Gier | 222/333 |
| 6,412,664 | B1 | * | 7/2002 | Wolff et al. | 222/211 |
| 6,454,130 | B1 | * | 9/2002 | Miller et al. | 222/94 |
| 6,523,720 | B1 | | 2/2003 | Robbins, III | |
| 6,609,694 | B2 | | 8/2003 | Francois et al. | |
| 6,685,041 | B1 | * | 2/2004 | Geisinger | 215/6 |
| 6,837,402 | B2 | | 1/2005 | Cardia | |
| 7,014,075 | B2 | * | 3/2006 | Bonifacio et al. | 222/503 |
| 7,198,162 | B2 | | 4/2007 | Francois et al. | |
| 2004/0079766 | A1 | | 4/2004 | Kokubo | |
| 2004/0245290 | A1 | | 12/2004 | Hagihara | |
| 2005/0072788 | A1 | | 4/2005 | Lieberman et al. | |
| 2005/0167455 | A1 | | 8/2005 | Yim | |
| 2006/0175357 | A1 | | 8/2006 | Hammond | |

FOREIGN PATENT DOCUMENTS

| | | | | |
|---|---|---|---|---|
| JP | 2004001836 | | 1/2004 | |
| WO | WO9303338 | * | 2/1993 | 222/456 |
| WO | 9513220 | | 5/1995 | |
| WO | WO02074650 | * | 9/2002 | 222/503 |

OTHER PUBLICATIONS

Intl PCT Application No. PCT/US07/77551 International Search Report, Sep. 4, 2007.

Intl PCT Application No. PCT/US07/77551 Written Opinion, Sep. 4, 2007.

* cited by examiner

DISPENSING CLOSURE WITH OBSTRUCTED, OFFSET, NON-LINEAR FLOW PROFILE

CROSS REFERENCE TO RELATED APPLICATION

This application is related to and claims priority from provisional patent application Ser. No. 60/893,883 filed Mar. 8, 2007 and earlier filed provisional patent application Ser. No. 60/824,322 filed Sep. 1, 2006 both of which are incorporated herein by reference.

BACKGROUND OF THE INVENTION

The present invention relates to container closures, and more particularly to squeeze-type container dispensing closures.

There are two major trends occurring in the design of dispensing containers and closures. The first trend is a focus on providing a "clean pour" during dispensing of the product. Many food products, such as mustard and ketchup, have a high viscosity and require the user to tip the container, shake down the product and then squeeze the container to dispense the product. Past dispensing closures tended to leak product onto the top deck of the closure after dispensing, creating a messy appearance and often requiring cleaning to reseal the closure. The current emphasis in "clean pour" design is on preventing spurting of the product when the container is inverted to the dispensing position and/or shaken down, and creating a "suck-back" effect as pressure is released from the container to draw the product back into the closure.

A second trend is a growing number of dispensing containers and closures being designed so that they can be stored in an inverted position, i.e. cap down. In this regard, the product is always located right at the dispensing closure for easy dispensing right from storage. This reduces the need to tip and shake the container to push the product down to the dispensing closure. There is a balance however, between having the product at the closure for dispensing and the need to prevent the product from immediately spurting out once the lid of the closure is opened.

Both of these trends have resulted in the design of dispensing closures having various types of valve structures that facilitate both a clean pour and inverted storage. For example, a silicone valve structure is illustrated and described in U.S. Pat. No. 5,271,531. While these silicone valves have been widely accepted by both the manufacturers and the consumers, they are somewhat more difficult to manufacture, as they require several inter-fitting parts, and thus they tend to be more expensive than traditional one-piece dispensing closures.

Another perceived drawback to the silicone valve closure is that they are constructed out of two different types of plastic and thus, from a recycling standpoint, they are more difficult to recycle because the silicone valve must be separated from the plastic closure body for recycling. While this is not a major issue in the United States, at least yet, it is currently a major issue in Europe where recycling is extremely important and even mandated in some countries.

Other designs of dispensing closures focus on the use of interior partitions to slow the flow of the product exiting the dispensing orifice. For example, U.S. Pat. No. 5,123,575 discloses a design of a dispensing closure having multiple chambers. This patent discloses a container for motor oil with three interior chambers, namely a primary chamber between the first partition and the bottom wall, a secondary partition between the first and second partitions and a tertiary chamber between the top wall and the second partition. While the concept of the design may provide the desired flow characteristics, the design is virtually impossible to mold using conventional injection molding or blow molding techniques and thus is not commercially feasible.

U.S. Pat. No. 5,819,994 also discloses a dispensing closure using multiple chambers. This patent discloses a flow controlling cap for a fluid (water) container that controls fluid flow by means of gravity and pressure, and has a first chamber formed by a first hollow cylinder and a second chamber formed by a second hollow cylinder having a greater diameter than the first hollow cylinder. While the circuitous path of this design is effective for water, the flow characteristics of water are different than other viscous fluids and thus the design is not believed to be suited for other more viscous products. In short, it would be difficult to force viscous fluids through the multi-chamber design.

Accordingly, there exists a need in the industry for a one-piece dispensing closure that provides a "clean pour" and prevents premature flowing of viscous product prior to squeezing the dispensing container. In addition, there exists a need a design of a dispensing closure that is easy to mold and made of one type of recyclable plastic.

SUMMARY OF THE INVENTION

The present invention preserves the advantages of existing dispensing closures while providing new advantages not found in currently available dispensing closures and overcoming many disadvantages of such currently available dispensing closures.

The general concept of the present invention is to provide a non-linear flow path from an interior of the dispensing closure to an exterior of the dispensing closure so that the product does not immediately spurt out upon opening of the closure lid and/or inverting and shaking the container to move the product toward the dispensing orifice.

Generally, each of the embodiments comprises a closure body having an upper deck and a skirt depending from the upper deck where the skirt is configured and arranged to mount to a product container (not shown). The product container may be a conventional squeeze-type container or an inverted type container. Preferably, the skirt is internally threaded for threaded mounting on a product container.

A flow conduit extends through the upper deck for the passage of a viscous product, such as a condiment (i.e. ketchup or mustard). The flow conduit includes an entry orifice (inside the container) having an entrance axis and an exit orifice (outside the container) having an exit axis. In each of the embodiments, the entrance axis is offset from the exit axis to provide a non-linear flow path from the interior of the closure to the exterior of the closure.

In a first embodiment, the entrance orifice is a located in the side wall of the flow conduit, wherein the entrance axis is perpendicular to the exit axis. The bottom wall of the flow conduit thus prevents the direct flow of product into the flow conduit along the exit axis.

In another embodiment, the flow conduit is expanded to the side, and the entrance orifice is located in a bottom wall of the flow conduit but offset from the exit orifice. The entrance axis is parallel to but not co-linear with (i.e. offset) the exit orifice. Again, the bottom wall of the flow conduit thus prevents the direct flow of product into the flow conduit along the exit axis.

In yet another embodiment, the flow conduit includes a suspended central disc, which forms a bottom wall. The central disc is suspended within the flow conduit by four downwardly depending arms, each distal end of the depending arms being attached to the central disc and each proximal end of the depending arms being attached to the interior wall of the flow conduit. This is essentially a modification of the first "side entry" embodiment, but now with four entrance orifices having entrance axes that are perpendicular to the exit axis.

It is therefore an object of the present invention to provide a one-piece low cost dispensing closure that does not include a valve structure.

It is a further object of the embodiment to provide a dispensing closure having a "clean-pour" dispensing characteristic.

Another object of the embodiment is to provide a dispensing closure having a sufficient flow restriction, either within the flow path or surrounding the flow path, to counter product head pressure created by either storing the product in an inverted condition, or head pressure created when an upright container is quickly inverted to dispense product.

Another object of the embodiment is to provide an obstructed flow path or a non-linear flow path from an interior of the dispensing closure to an exterior of the dispensing closure. Another object of the embodiment is to provide a flow conduit that allows product to flow freely upon squeezing while also providing a passive flow restriction.

Other objects, features and advantages of the invention shall become apparent as the description thereof proceeds when considered in connection with the accompanying illustrative drawings.

BRIEF DESCRIPTION OF THE DRAWINGS

The novel features which are characteristic of the dispensing closure are set forth in the appended claims. However, the dispensing closure, together with further embodiments and attendant advantages, will be best understood by reference to the following detailed description taken in connection with the accompanying drawing Figures.

DETAILED DESCRIPTION OF THE PREFERRED EMBODIMENTS

Figure 1:
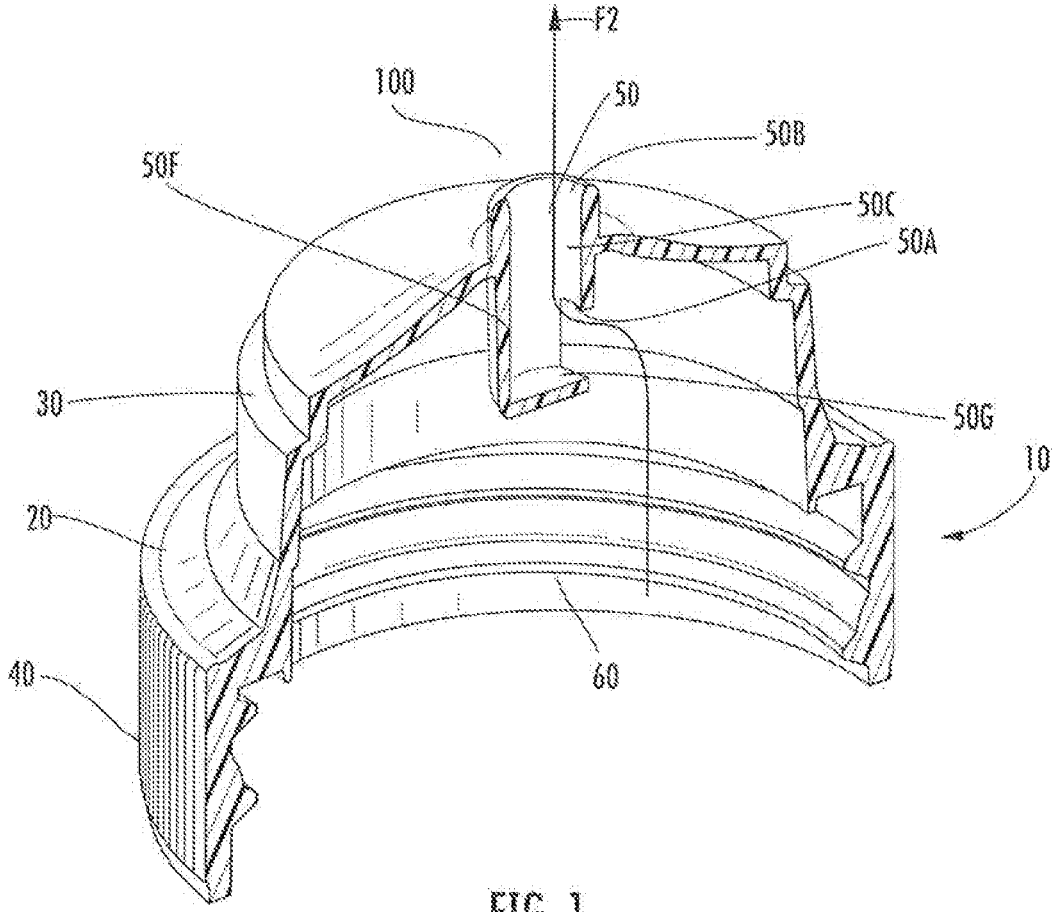
FIG. 1 is a cross-sectional view of a first embodiment of a dispensing closure constructed in accordance with the teachings of the present invention.

Referring now to the drawings, the dispensing closure 10 of the instant invention is illustrated in FIGS. 1-6. As will hereinafter be more fully described, the instant dispensing closure 10 includes a unique flow conduit arrangement, which includes an offset, obstructed, and non-linear flow path. The unique arrangement provides anti-spurting both in upright and inverted containers as well as "suck-back" for cleaner product dispensing, i.e. "clean pour".

Generally, each of the embodiments includes a closure body 20 having an upper deck 30, and a skirt 40 depends from the upper deck 30 where the skirt 40 is configured and arranged to mount to a product container (not shown), such as a conventional squeeze-type container or an inverted-type container. Preferably, the skirt 40 is internally threaded for threaded mounting on a product container. However, it is to be understood that other skirt mounting arrangements are also contemplated within the scope of the invention, and the invention should not be limited to the inwardly threaded skirt as the only means for mounting.

Referring briefly to FIGS. 3-6, this embodiment includes a closure lid 130 and a living hinge structure 140 connecting the closure lid 130 to the closure body 20. It is to be understood that any of the embodiments may optionally include a closure lid 130, and the lack of such a lid in any of the illustrated embodiments is not to be construed as a limitation. In fact, most of the commercial embodiments will likely include a lid structure. However, for purposes of describing the preferred flow conduits, it was not deemed necessary to show the lid 130 in each embodiment.

Referring back to FIGS. 1 and 1A, a flow conduit 50 extends through the upper deck 30 for the passage of a viscous product, such as a food condiment (i.e. ketchup or mustard). The flow conduit 50 is generally defined by an interior wall 50C, an exterior wall 50F, and a bottom wall 50G (baffle). The flow conduit 50 includes an entrance orifice 50A (inside the container) having an entrance axis X and an exit orifice 50B (outside the container) having an exit axis Y. In each of the embodiments, the entrance axis X is offset from the exit axis Y to provide a non-linear flow path (see arrows F2) from an interior 60 of the closure 10 to an exterior 100 of the closure 10.

Figure 1A:
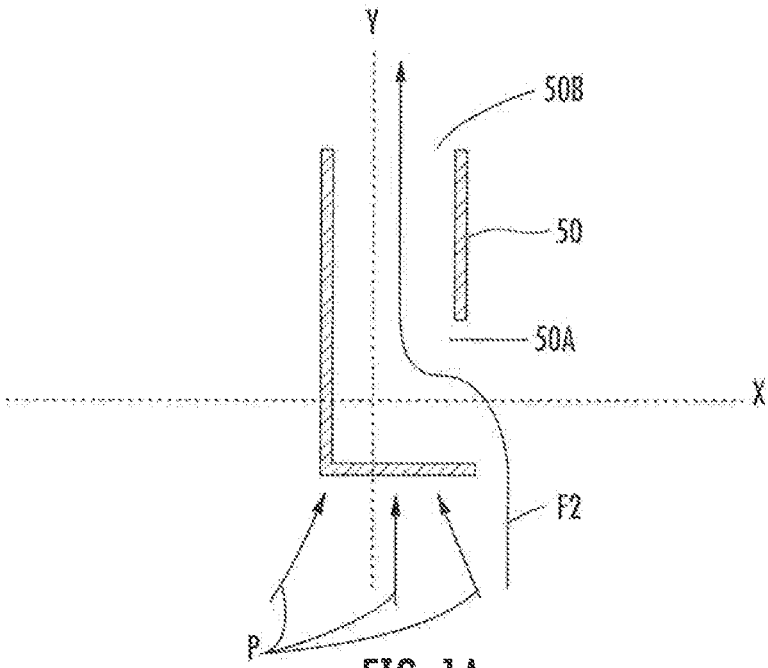
FIG. 1A is a diagrammatical view thereof showing the flow path.

In the first embodiment as illustrated in FIGS. 1 and 1A, the entrance orifice 50A is located in the side-wall of the flow conduit 10, wherein the entrance axis X is perpendicular to the exit axis Y. The bottom wall 50G of the conduit thus prevents the direct flow of product (see arrows P—FIG. 1A) into the flow conduit along the exit axis Y and acts as a baffle to counter product head pressure created by either storing the product in an inverted condition, or head pressure created when an upright container is quickly inverted to dispense product. Flow of the product is shown by arrow F2.

The baffling effect is also enhanced by the passage of the product from the container, through the small entrance orifice 50A and into the interior of the flow conduit 50. The velocity of the product will increase as it travels through the entrance orifice 50A. However, the velocity of the product then decreases as it travels into the larger interior volume of the flow conduit 50 before it leaves through the exit orifice 50B. Spurting thus occurs into the interior of the flow conduit 50 and not directly out of the exit orifice. Accordingly, when the container is inverted, and is rapidly shaken up and down by a user to dispense the product, the product first decelerates into the larger volume interior flow conduit 50, and does not spurt out the exit orifice 50B. When pressure is applied to the squeeze container, the product is then forced out of the exit orifice 50B.

It is to be noted that the dimensions of the flow conduit 50 are adjustable, depending upon the viscosity of the product stored within an interior 60 of the dispensing closure 10. For example, ketchup has a lower viscosity than mustard. If ketchup is contained within the interior 60 of the dispensing closure 10, it may be desirable for the flow conduit 50 to be smaller in size or dimension to achieve a lower flow volume for the ketchup. It is also noted, that the invention is equally applicable to viscous products other than food condiments, such as shampoos, gels, etc.

Figure 2:
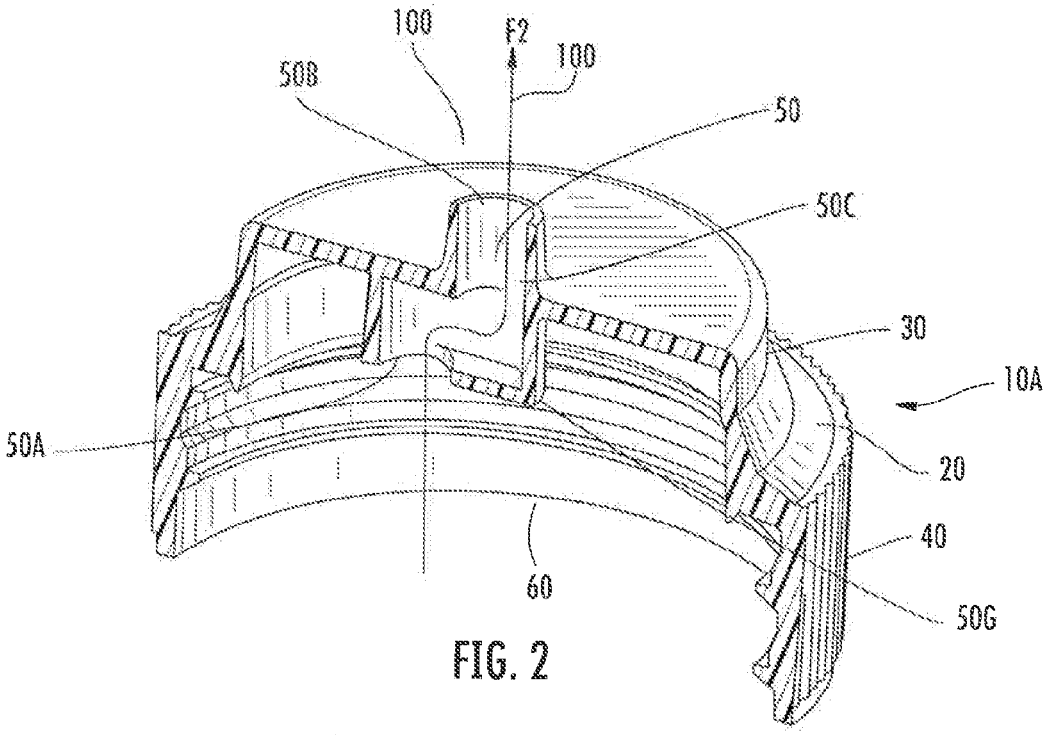
FIG. 2 is a cross-sectional view of a second embodiment of a dispensing closure constructed in accordance with the teachings of the present invention.
Figure 2A:
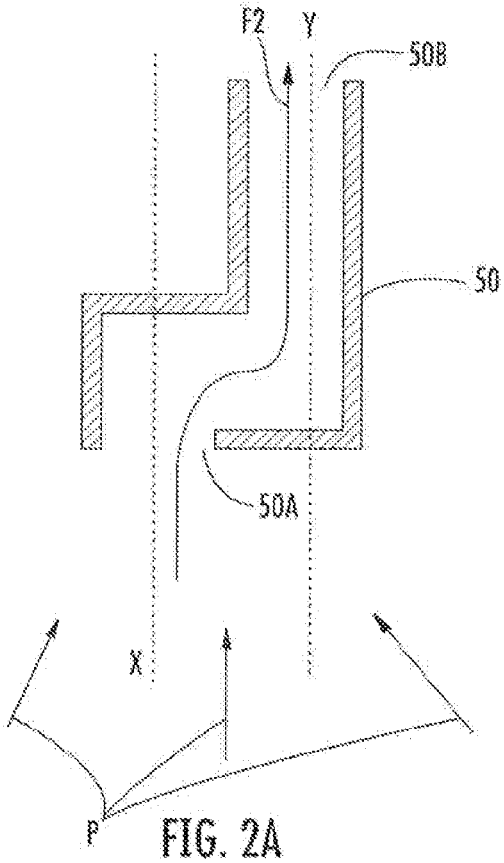
FIG. 2A is a diagrammatical view thereof showing the flow path.
Figure 3:
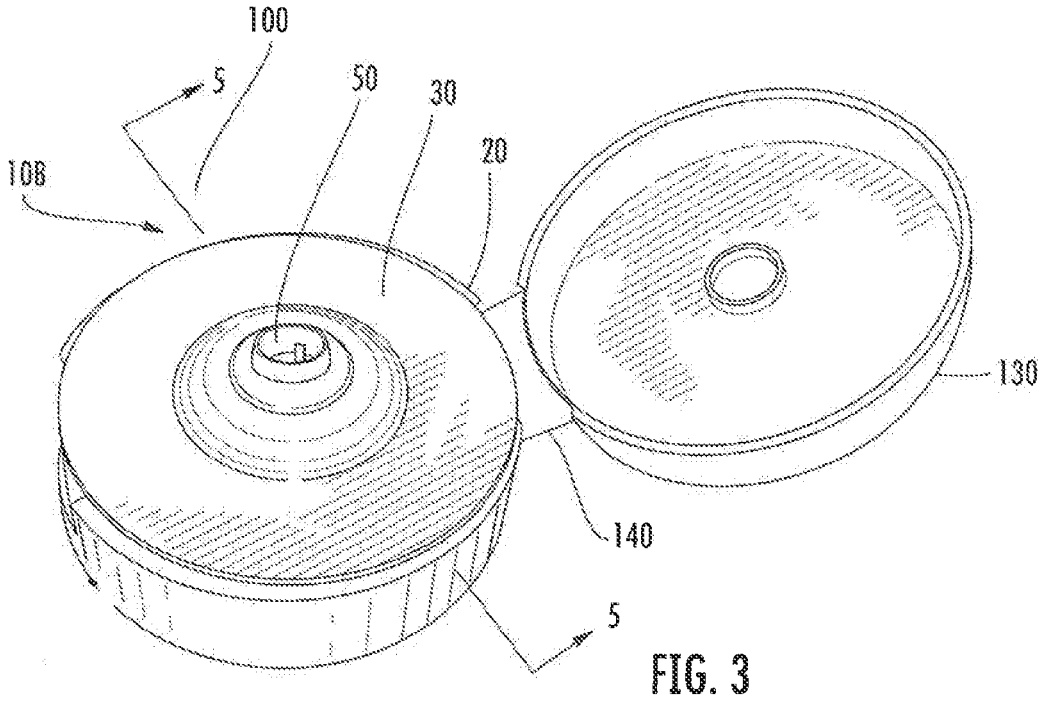
FIG. 3 is a perspective view of a third embodiment of a dispensing closure constructed in accordance with the teachings of the present invention.
Figure 4:
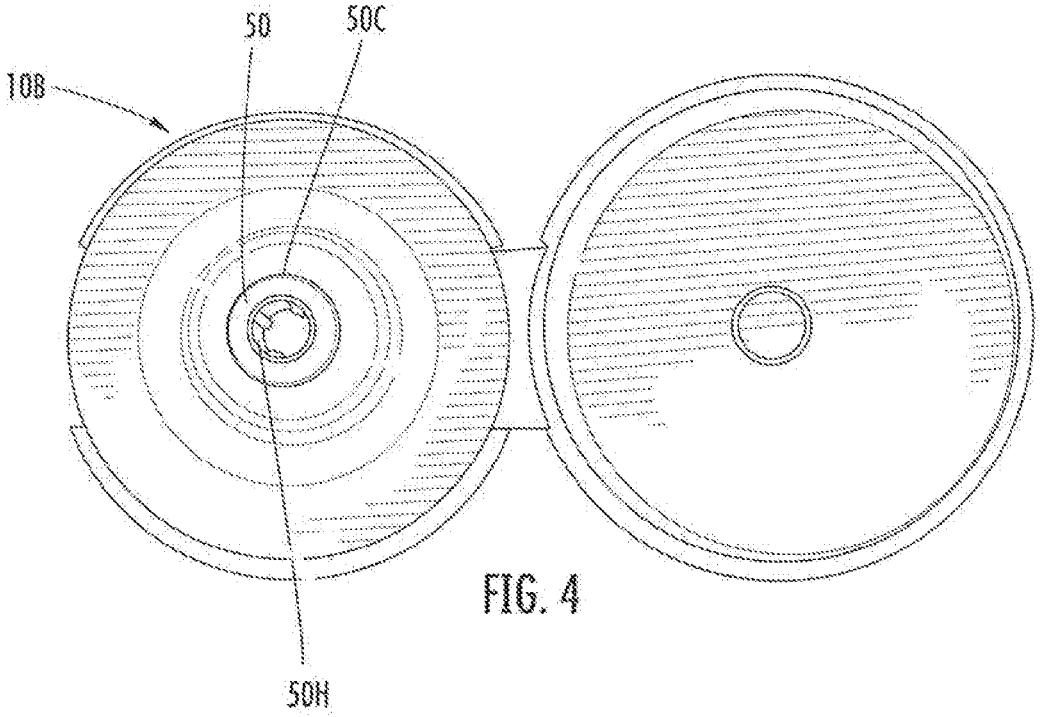
FIG. 4 is a top view thereof.
Figure 5:
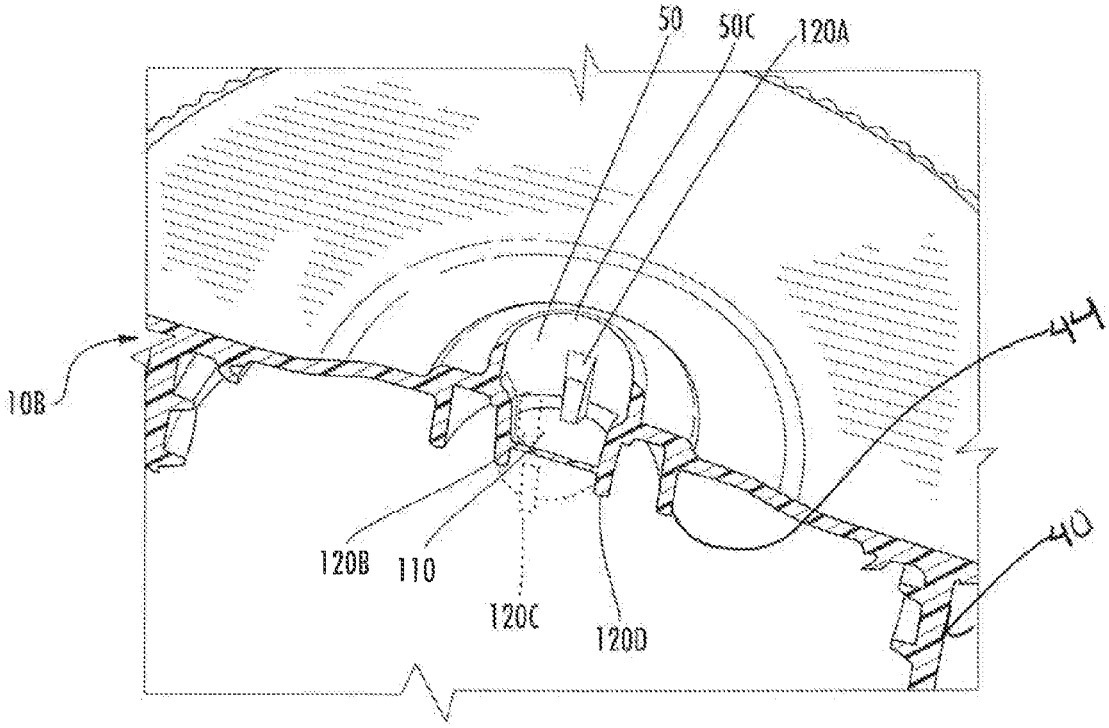
FIG. 5 is a cross-sectional view thereof as taken along line 5-5 of FIG. 3.

Now referring to FIGS. 2 and 2A, a second embodiment of the dispensing closure illustrated and generally indicated at 10A. In this second embodiment, the flow conduit 50 is expanded to the side, and the entrance orifice 50A is located in a bottom wall 50G, but offset from the exit orifice 50B. The entrance axis X is parallel to but not co-linear with the exit axis Y. Again, the bottom wall 50G of the flow conduit prevents the direct flow of product (see arrows P—FIG. 2A) into the flow conduit 50 along the exit axis Y. Flow of the product is shown by arrow F2.

All of the operational descriptions provided herein above for the first embodiment of the dispensing closure 10 are applicable to the second embodiment of the dispensing closure 10A as well.

Figure 6:
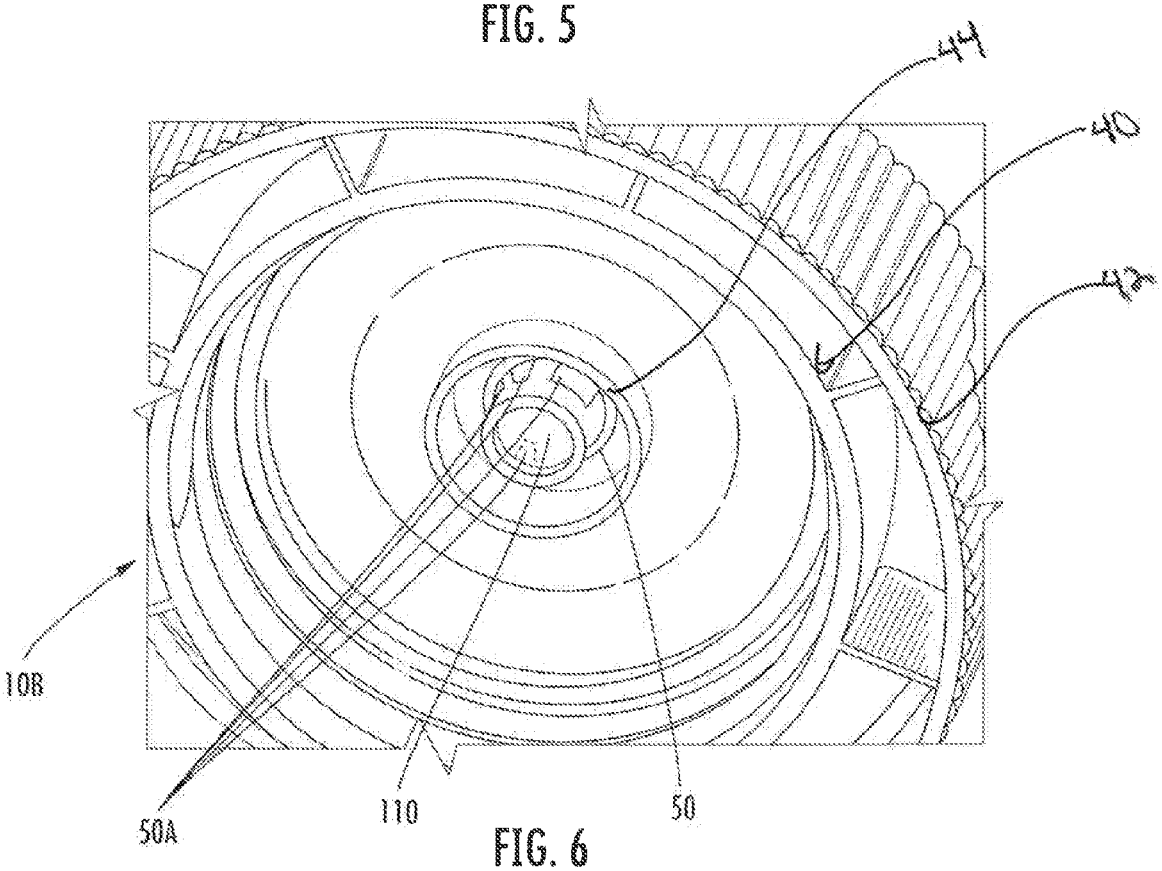
FIG. 6 is a bottom view thereof.
Figure 6A:
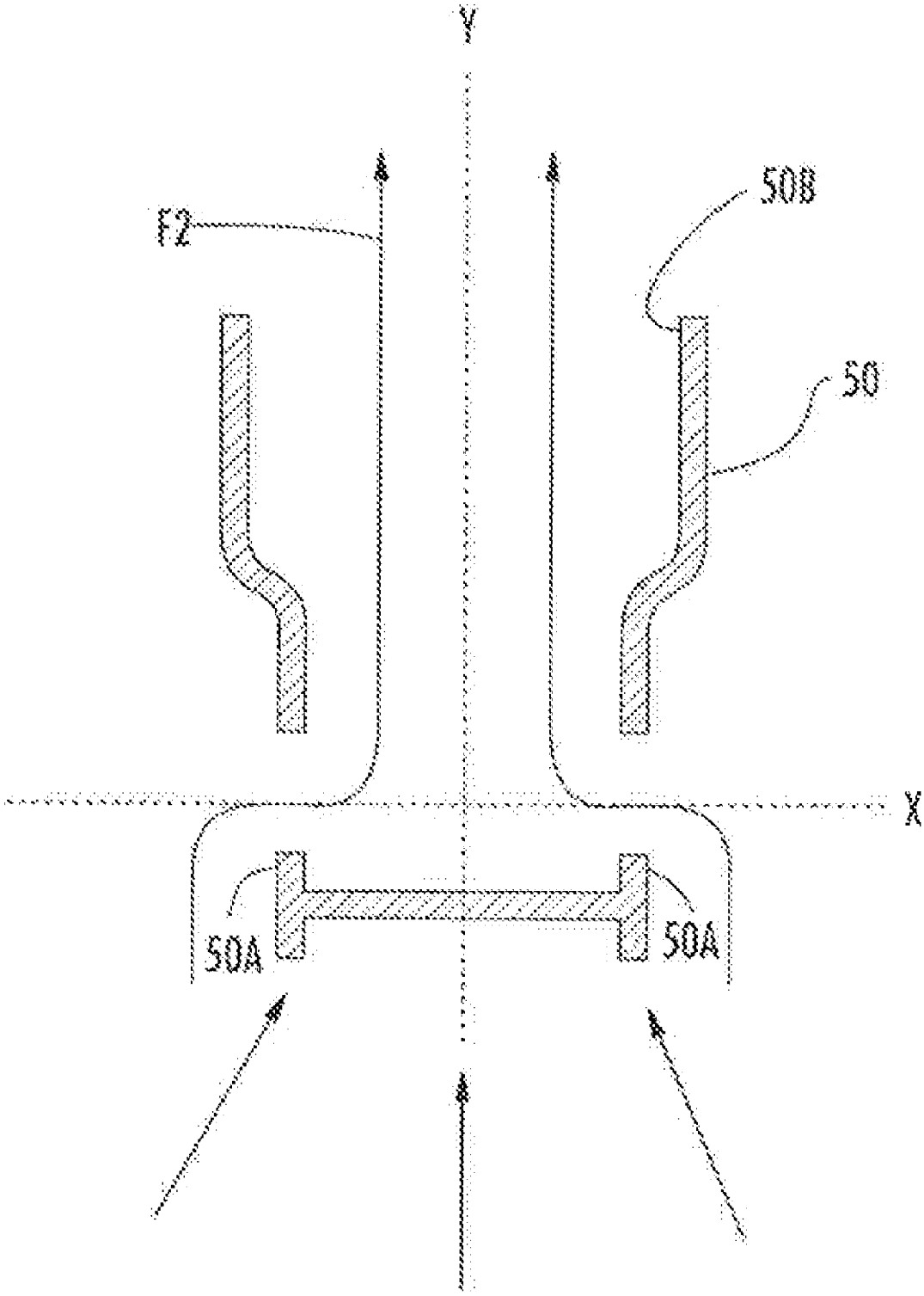
FIG. 6A is a diagrammatical view thereof.

Now referring to FIGS. 3-6, a third embodiment of the dispensing closure is illustrated and generally indicated at 10B. As mentioned previously, the embodiment of the dispensing closure 10B has a closure lid 130 attached to the closure body 20 of the dispensing closure. A living hinge structure 140 is used to connect the closure lid 130 and the closure body 20 to control the movement of the closure lid 130. Referring to FIG. 6, an outer skirt 40 and an inner skirt 44 depend below the upper deck 30. The inner skirt 44 also extends below the entrance orifice 50A. The outer skirt 40 is configured and arranged to mount to a product container. In one embodiment, a decorative outer wall 42 may be attached to the outer skirt 40.

The flow conduit 50 includes a suspended central disc 110, which forms a bottom wall of the conduit. The central disc 110 is suspended within the flow conduit 50 by four downwardly depending arms (120 A-D), each distal end of the depending arms (120A-D) being attached to the central disc 110 and each proximal end of the depending arms (120A-D) being attached to the interior wall 50C of the flow conduit 50.

In a preferred embodiment, the four depending arms (120A-D) are equally spaced around an outer edge of the central disc 110. Alternatively, more than four arms or less than four depending arms (120A-D) may be dispersed in a non-uniform manner along the outer edge of the central disc 110.

The third embodiment 10B is essentially a modification of the first "side-entry" embodiment 10, but with four entrance orifices 50A having entrance axes X that are perpendicular to the exit axis Y.

Based on the disclosure above, the embodiments provide a one-piece dispensing closure. Also, the embodiments provide a one-piece dispensing closure having a "clean-pour" dispensing characteristic. Furthermore, the embodiments provide a one-piece dispensing closure having a sufficient flow restriction within the flow path to counter product head pressure created by either storing the product in an inverted condition, or head pressure created when an upright container is quickly inverted to dispense product.

It would be appreciated by those skilled in the art that various changes and modifications can be made to the illustrated embodiments without departing from the spirit of the embodiments. All such modifications and changes are intended to be covered by the appended claims.

What is claimed is:

1. A one-piece dispensing closure comprising:

a closure body;

a closure lid;

a living hinge structure hingeably connecting said closure lid to said closure body, said closure body including an upper deck;

an outer skirt depending below the upper deck, said outer skirt being configured and arranged to mount a product container;

a flow conduit extending through said upper deck, said flow conduit including more than one entrance orifice having an entrance axis and a single exit orifice having an exit axis, said entrance axis being perpendicular to said exit axis, said flow conduit having a substantially horizontal bottom wall suspended beneath said upper deck by a plurality of substantially vertical arms depending downwardly from said upper deck, said bottom wall having an area about the same as a cross-sectional area of the flow conduit taken along a plane parallel to the entrance axis, wherein said bottom wall baffles direct flow from an interior of said product container through said exit orifice; and an inner skirt depending below the upper deck, said inner skirt being spaced radially inwardly from said outer skirt away from a sidewall of said product container, said inner skirt encircling said flow conduit.

2. The dispensing closure of claim 1, wherein said plurality of arms comprise at least four depending arms equally spaced around a peripheral edge of said bottom wall.

3. The dispensing closure of claim 2, wherein said at least one entrance orifice is at least four entrance orifices.

4. The dispensing closure of claim 1, wherein the one-piece dispensing closure is made by process of injection molding.

5. The dispensing closure of claim 1, wherein the outer skirt is internally threaded for attachment to a product container.

6. The dispensing closure of claim 1, wherein said upper deck is tiered near said exit orifice.

7. The dispensing closure of claim 1, wherein said exit orifice is located on exterior of said product container.

8. The dispensing closure of claim 1, wherein said lid includes a circular wall depending from an inner surface of said lid to close said exit orifice.

9. The dispensing closure of claim 1, wherein said entrance orifice is located within an interior of said product container.

10. The dispensing closure of claim 1, wherein said flow conduit has a diameter substantially less than the diameter of the upper deck.

11. The dispensing closure of claim 1, wherein said upper deck has a surface area equal to a horizontal cross-sectional surface area of product container neck.

12. The dispensing closure of claim 1, wherein said inner skirt extends below said entrance orifice.

13. The dispensing closure of claim 1, wherein said flow conduit includes a portion extending above and below said upper deck.

14. A one-piece dispensing closure comprising:

a closure body;

a closure lid;

a living hinge structure hingeably connecting said closure lid to said closure body, said closure body including an upper deck;

an outer skirt depending below the upper deck, said outer skirt being configured and arranged to mount to a product container;

a flow conduit extending through said upper deck, said flow conduit including a portion extending above and below said upper deck, said flow conduit including at least one entrance orifice having an entrance axis and a single exit orifice having an exit axis, said entrance axis being perpendicular to said exit axis, said flow conduit having a substantially horizontal bottom wall suspended beneath said upper deck by a plurality of substantially vertical arms depending downwardly from said upper deck, said bottom wall having an area about the same as a cross-sectional area of the flow conduit taken along a plane parallel to the entrance axis, wherein said bottom wall baffles direct flow from an interior of said product container through said exit orifice; and an inner skirt depending below the upper deck, said inner skirt being spaced radially inwardly from said outer skirt away from a sidewall of said product container, said inner skirt encircling said flow conduit and extending below said at least one entrance orifice.

15. A one-piece dispensing closure comprising:

a closure body;

a closure lid;

a living hinge structure hingeably connecting said closure lid to said closure body, said closure body including an upper deck;

an outer skirt depending below the upper deck, said outer skirt being configured and arranged to mount to a product container;

a flow conduit extending through said upper deck, said flow conduit including a portion extending above and below said upper deck, said flow conduit has a diameter substantially less than the diameter of said upper deck, said flow conduit including at least one entrance orifice having an entrance axis and a single exit orifice having an exit axis, said entrance axis being perpendicular to said exit axis, said flow conduit having a substantially horizontal bottom wall suspended beneath said upper deck by a plurality of substantially vertical arms depending downwardly from said upper deck, said bottom wall having an area about the same as a cross-sectional area of the flow conduit taken along a plane parallel to the entrance axis, wherein said bottom wall baffles direct flow from an interior of said product container through said exit orifice; and an inner skirt depending below the upper deck, said inner skirt being spaced radially inwardly from said outer skirt away from a sidewall of said product container, said inner skirt encircling said flow conduit and extending below said at least one entrance orifice.

16. The dispensing closure of claim 15, wherein said exit orifice is located on exterior of said product container.

17. The dispensing closure of claim 16, wherein said entrance orifice is located within an interior of said product container.

18. The dispensing closure of claim 17, wherein said upper deck has a surface area equal to a horizontal cross-sectional surface area of product container neck.

19. The dispensing closure of claim 18, wherein the outer skirt is internally threaded for attachment to a product container.

20. The dispensing closure of claim 19, wherein a portion the flow conduit and the inner skirt extend below the upper deck to a substantially similar horizontal plane.

* * * * *